US005980219A

United States Patent [19]

Spurny

[11] Patent Number: 5,980,219

[45] Date of Patent: Nov. 9, 1999

[54] PISTON-TYPE COMPRESSOR, ESPECIALLY FOR GENERATING COMPRESSED AIR IN MOTOR VEHICLES

[75] Inventor: Dieter Spurny, Reichertshausen, Germany

[73] Assignee: Knorr-Bremse Systems fur Nutzfahrzeuge GmbH, Munich, Germany

[21] Appl. No.: 09/011,419

[22] PCT Filed: Jun. 19, 1996

[86] PCT No.: PCT/DE96/01084

§ 371 Date: Feb. 6, 1998

§ 102(e) Date: Feb. 6, 1998

[87] PCT Pub. No.: WO97/07335

PCT Pub. Date: Feb. 27, 1997

[30] Foreign Application Priority Data

Aug. 11, 1995 [DE] Germany ..... 195 29 684

[51] Int. Cl.[6] ..... F04B 49/00

[52] U.S. Cl. ..... 417/296; 417/297

[58] Field of Search ..... 417/296, 297, 417/298, 435, 440; 137/599.2, 512.15

[56] References Cited

U.S. PATENT DOCUMENTS

| | | | |
|---|---|---|---|
| 2,043,849 | 6/1936 | Bixler . | |
| 2,515,746 | 3/1950 | Cody . | |
| 2,852,184 | 9/1958 | Stolte . | |
| 3,986,798 | 10/1976 | Lindell et al. . | |
| 4,610,612 | 9/1986 | Kocher | 418/195 |
| 5,101,857 | 4/1992 | Heger et al. | 137/599 |
| 5,266,016 | 11/1993 | Kandpal . | |
| 5,327,932 | 7/1994 | Rozek | 137/512.15 |
| 5,454,397 | 10/1995 | Miszczak . | |
| 5,558,508 | 9/1996 | Sesano et al. . | |
| 5,603,611 | 2/1997 | Tarutani et al. . | |

FOREIGN PATENT DOCUMENTS

| | | |
|---|---|---|
| 372 154 B1 | 6/1990 | European Pat. Off. . |
| 571 715 A1 | 12/1993 | European Pat. Off. . |
| 705 977 A1 | 6/1996 | European Pat. Off. . |
| 1 129 784 | 5/1962 | Germany . |
| 1142478 | 1/1963 | Germany . |
| 6946784 | 1/1969 | Germany . |
| 1957668 | 5/1971 | Germany . |
| 7200686 | 1/1972 | Germany . |
| 2410705 | 9/1975 | Germany . |
| 3305791 A1 | 8/1984 | Germany . |
| 3813539C2 | 11/1988 | Germany . |
| 3909531A1 | 6/1990 | Germany . |
| 3940099A1 | 6/1991 | Germany . |
| 4125123A1 | 2/1992 | Germany . |
| 494590A1 | 7/1992 | Germany . |
| 59-208181 | 11/1984 | Japan . |
| 992232 | 3/1962 | United Kingdom . |
| 1132506 | 11/1968 | United Kingdom . |
| 1409589 | 10/1975 | United Kingdom . |
| 2018364 | 10/1979 | United Kingdom . |
| 2044365 | 10/1980 | United Kingdom . |
| 2 165 317A | 4/1986 | United Kingdom . |
| 2208 180 | 3/1989 | United Kingdom . |

OTHER PUBLICATIONS

Energie Fluide, vol. 13, No. 74, Oct. 1, 1974, Paris, France, see p. 16, col. 3, Paragraph 3.

*Primary Examiner*—Teresa Walberg
*Assistant Examiner*—Krishan Pasrija
*Attorney, Agent, or Firm*—Barnes & Thornburg

[57] ABSTRACT

In a piston-type compressor, especially for generating compressed air in motor vehicles, there is a suction plate on the underside of a valve support, clamped between the cylinder and cylinder head, facing the compressor piston. The suction plate consists of an active and an inactive section. The active section, preferably consisting of a tongue-shaped active plate fitted in the center, operates in relation to suction apertures in the valve support while the inactive section of the suction plate has at least one delivery aperture in active connection with at least one delivery aperture in the valve support. The suction plate takes the form of a disc, thus virtually eliminating waste space. The suction plate can be fitted between the cylinder and the valve support without additional components; when used in an energy-saving system, the suction plate can be rotated to produce differing degrees of overlap between suction and delivery apertures.

7 Claims, 2 Drawing Sheets

PISTON-TYPE COMPRESSOR, ESPECIALLY FOR GENERATING COMPRESSED AIR IN MOTOR VEHICLES

BACKGROUND AND SUMMARY OF THE INVENTION

The invention generally relates to a piston-type compressor and more specifically to an improved suction plate for a piston compressor.

In the case of piston-type compressors shown for example, in (German Patent Documents DE 39 04 172 A1 and DE 39 09 531 A1), suction plates are provided which have an essentially circular shape and, by means of their freely movable part, that is, the part which can be swivelled perpendicularly to the plane of the valve support plate, are adapted to the position of the suction apertures situated in the valve support. The recessed interior area of such suction apertures as well as partial areas outside their outer contours may be called a waste space since a waste volume remains in each case between the top side of the piston in its upper dead-center position and the underside of the valve support or of the valve support plate. The fitting-in of the suction plates takes place by pin elements or, when they are used on an energy saving system (German Patent Document DE 39 09 531 A1), by a toggle lever operating system which permits a displacement of the suction plate between two active positions, specifically the pumping position and the idling position.

Based on the above, it is an object of the invention to further develop a suction plate of the above-mentioned type, when using constructionally simple devices with respect to its fitting or fixing, such that the waste volume above the piston of the compressor is reduced to a minimum. Suction plates of this type must also be usable in energy-saving systems for piston-type compressors claiming the above-mentioned advantages.

The objects are obtained by a suction plate, which consists of an inactive section and an active section, and covers almost the whole cross-section above the piston of the compressor, that is, on the underside of the valve support. This results in almost no waste volume laterally to the active section in the upper dead-center position of the piston. The active section, which is preferably constructed as a tongue-shaped valve plate, and extends almost along the whole diameter of the plate disk body such that the two sides of the active section are limited by approximately semicircular inactive section sections with delivery apertures penetrating them.

The fixing of the suction plate takes place without additional mounting devices; that is, the suction plate can be inserted and clamped in between the cylinder and the valve support plate. For the purpose of a securing with respect to rotation, a notch is provided on the outer circumference of the suction plate, a projection on the cylinder or on the valve support plate engaging in this notch. The suction plate can also be advantageously used in the case of piston-type compressors with a so-called energy-saving system. As the result of their disk-shaped configuration, it can be rotated by a simple rotary drive in order to achieve a complete covering of the delivery apertures of the valve support or in order to achieve the desired partial opening of the suction apertures of the valve support.

Advantageous developments and further developments are listed in the claims.

In the following, the invention will be explained by means of embodiments with reference to the enclosed drawing.

DETAILED DESCRIPTION OF THE PREFERRED EMBODIMENTS

Figure 1:
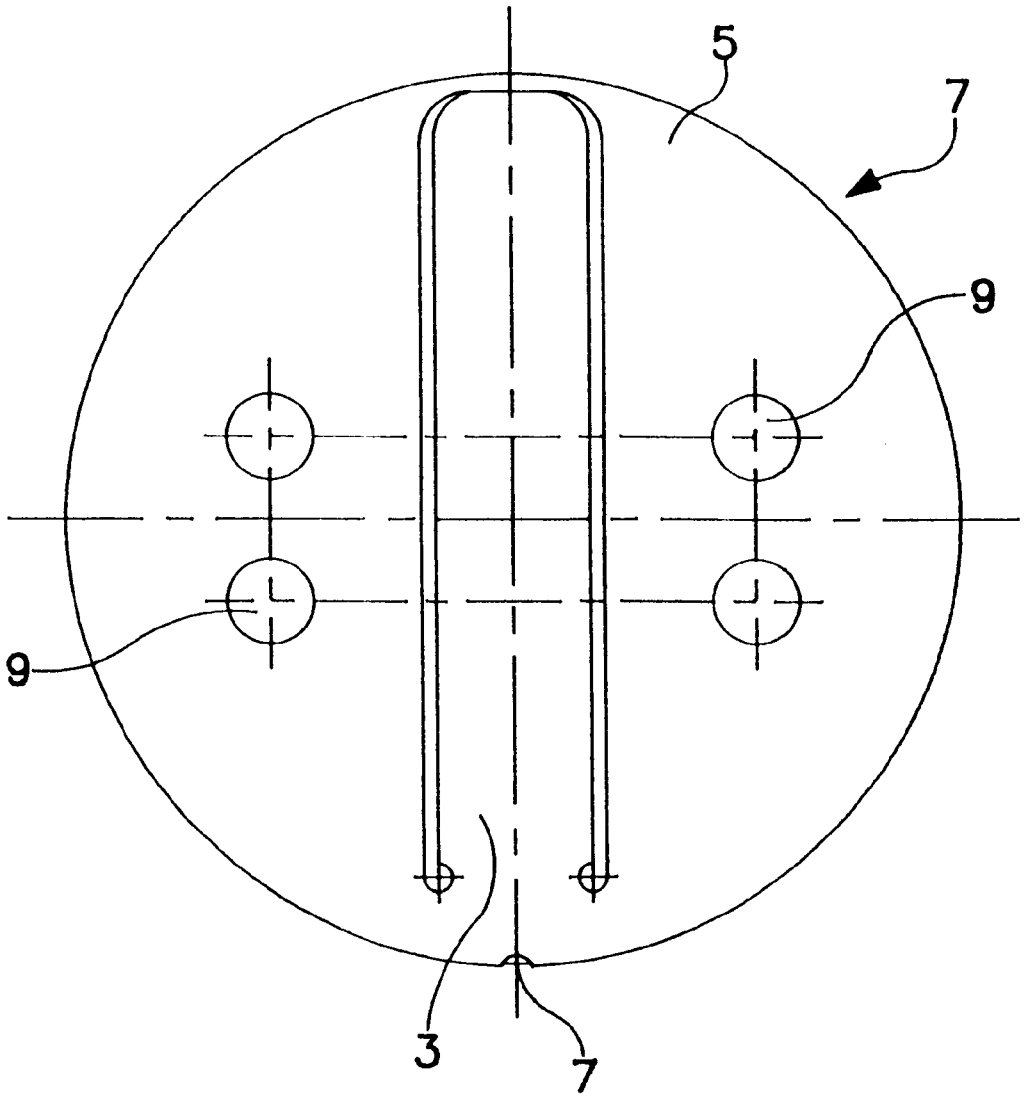
FIG. 1 is a top view of a suction plate according to the invention.

The suction plate 1 according to the invention, which is illustrated in FIG. 1 of the drawing and consists, for example, of spring steel, has two components, specifically an active section 3 and an inactive section 5. The active section 3 has a tongue-shaped construction and is connected by uniform material with the inactive section 5. The separation of the active section and of the inactive section is achieved with respect to manufacturing in a simple manner by a stamping operation. The inactive section 5 encloses the active section on all sides; that is, the whole suction plate is constructed as a disk which completely covers the inside diameter of the cylinder. Because of the disk shape, the fastening of the suction plate between the cylinder and the cylinder head is of a very simple nature. The suction plate rests by its outer circumference preferably on a ring shoulder of the bore of the cylinder and, by the valve support (not shown) situated on its top side, is held with respect to the shoulder on the top side of the cylinder. Thus, no additional clamping-in devices in the form of pin elements, etc. are required. For the purpose of securing the suction plate with respect to rotation, a notch 7 is provided on its outer circumference into which an inwardly directed projection (not shown) engages which is provided on the ring shoulder of the cylinder. By this securing with respect to rotation, it is ensured that the active section 3 in the form of a tongue-shaped valve support maintains the exact position with respect to the overlapping (not shown) suction apertures. In the same manner, the delivery apertures 9 (FIG. 1) situated in the inactive section 5 coincide in each case with the corresponding delivery apertures (not shown) in the valve support.

By the above-mentioned division of the suction plate into an active section and an inactive section and by the type of mounting between the cylinder and the valve support, the waste volume above the piston is reduced to a minimum since the inactive section 5 fills or covers the waste space which would exist in an adjoining position with respect to the active section. This waste space reduction is therefore effective independently of the thickness of the suction plate since the inactive section in each case has the thickness of the active section.

The invention is not limited to the embodiment illustrated in FIG. 1; that is, the suction plate 1 according to the invention can also be used in the case of compressors with an energy-saving system (German Patent Document DE 39 09 531 A1). In the case of constructions of this type, the suction plate 1 can be moved between the pumping phase illustrated in FIG. 2 and the idling phase (ESS phase) illustrated in FIG. 3. In the case of compressors of the mentioned construction, the suction plate takes up a position in the idling phase according to FIG. 3 in which the schematically outlined delivery apertures 11 of the also schematically outlined valve support 13 are covered by the suction plate 1 in such a manner that the delivery apertures 9 of the suction plate 1 are no longer in an alignment with the delivery apertures 11 of the valve support. In the pumping phase of FIG. 2, the delivery apertures 9 of the suction plate 1 are in alignment with the delivery apertures 11 of the valve support.

Figure 3:
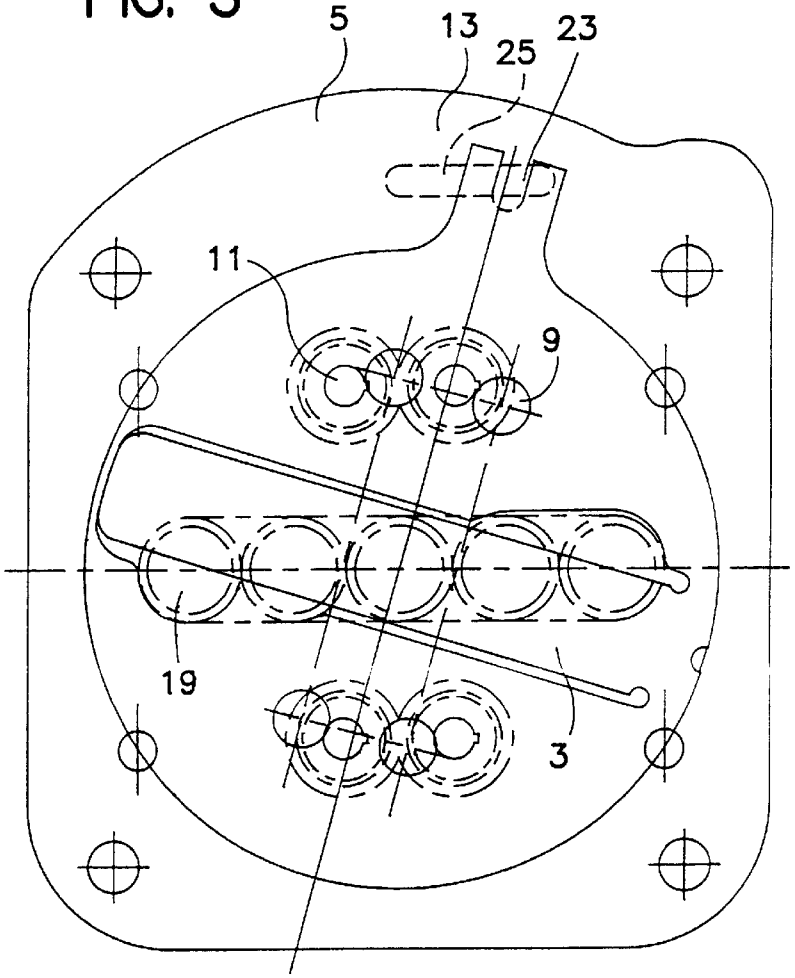
FIG. 3 is a top view comparable to FIG. 2 showing the suction plate in the idling phase in which it was rotated with respect to the arrangement according to FIG. 2.
Figure 2:
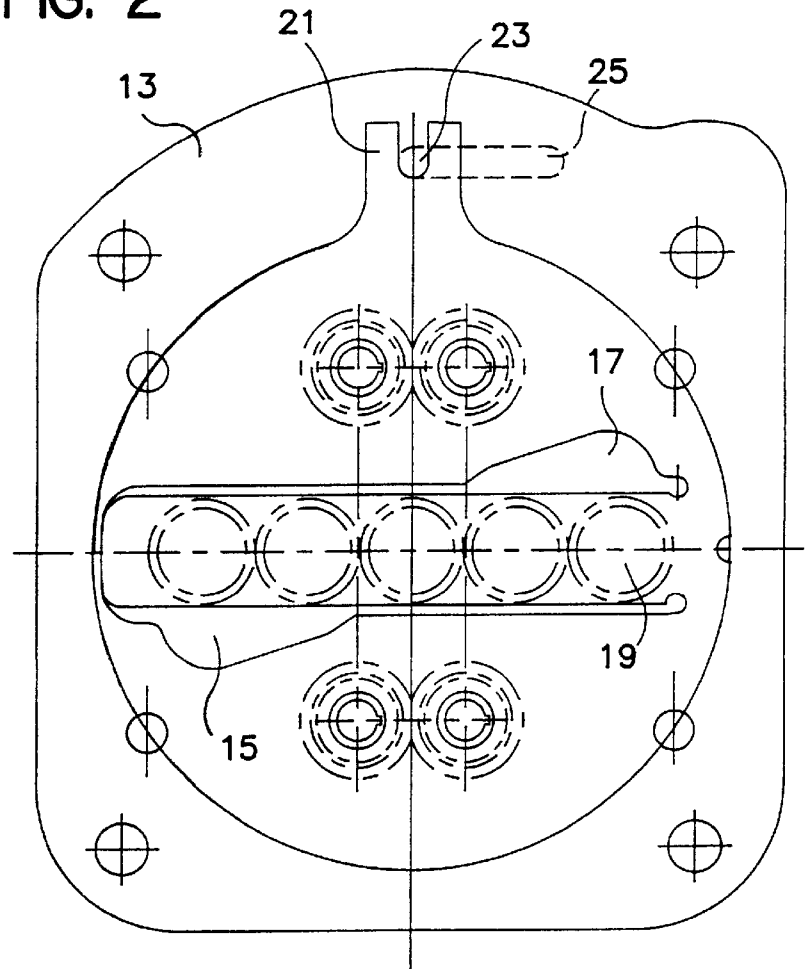
FIG. 2 is a top view of a suction plate suitable for the operation in an energy-saving system while showing a pumping phase.

In contrast to the embodiment according to FIG. 1 which illustrates a suction plate 1 which is secured with respect to a rotation, the of the embodiment of a rotatable suction plate is illustrated by FIGS. 2 and 3. One recess 15 or 17 respectively is provided on both sides of the active section 3. The two recesses 15 and 17 adjoin the free end or the clamping end of the active part and, with respect to their geometry, are selected such that, in the case of the idling phase or ESS phase illustrated in FIG. 3, a partial opening-up of the schematically illustrated suction apertures 19 of the valve support 13 is achieved. As a result, in the switch-off or idling position, the suction space (not shown) above the valve support is connected to the delivery space between the valve support and the piston with the result that the compressor operates in a closed cycle process and only friction, leakage flow and heat loss require minimal driving energy. In this case, no delivery reversal takes place any more in the delivery or compression space since, as explained above and illustrated in FIG. 3, the delivery apertures 9 and 11 are not aligned.

In contrast to the embodiment of FIG. 1, because of the recesses 15 and 17, a slight waste space according to the thickness dimension of the suction plate must be accepted. Nevertheless a significant reduction of the waste space or of the waste volume above the piston is achieved in contrast to conventional suction plates which consist only of an active section.

The suction plate 1 of the embodiment according to FIGS. 2 and 3 has a fork 21 on the circumference in which a schematically illustrated pin 23 engages. The pin 23 can be moved within an oblong hole 25 penetrating the valve support 13. In a manner not shown in detail, an operating piston which, in the idling phase, by way of a delivery regulator connected to the delivery connection of the compressor, can be switched in a manner known per se, in which case, in the delivery or pumping phase to the position illustrated in FIG. 3. The restoring of the operating piston and therefore the restoring of the suction plate from the position according to FIG. 3 into the position according to FIG. 2 takes place by spring force.

As in the case of the embodiment according to FIG. 1, the invention is not limited to the number and geometrical arrangement or assignment of the suction and delivery apertures. However, basically the two embodiments have in common that the inactive section used for the waste volume reduction acts statically with respect to the delivery aperture or the delivery apertures in the valve support, either in the open position according to FIG. 2 or in the closed position according to FIG. 3, while the active section 3, acting as the active plate or tongue, carries out opening and closing movements in the direction of the piston and away from it.

As mentioned above, the clamping of the suction plate between the cylinder and the valve support is very simple. In contrast to the embodiments of known plates, an additional part for the fixing of the suction plate is no longer necessary because, as a result of a deformation, the inactive section causes an inherent bracing.

The invention was explained by means of a valve support (seat plate) which is clamped in as a separate component between the cylinder head and the cylinder and may, for example, have coolant ducts. In the same manner, the suction plate according to the invention can be used in the case of valve supports which are constructed in a uniform material with the cylinder head. Although the present invention has been described and illustrated in detail, it is to be clearly understood that the same is by way of illustration and example only, and is not to be taken by way of limitation. The spirit and scope of the present invention are to be limited only by the terms of the appended claims.

List of Reference Numbers 1 suction plate
3 active part
5 inactive part
7 notch
9 delivery aperture
11 delivery aperture
13 valve support
15 recess
17 recess
19 suction aperture
21 fork
23 pin

I claim:

1. Piston-type compressor having a suction plate which acts with respect to a valve support of the piston-type compressor and which, for use in an energy-saving system, can be moved between a position on the valve support corresponding to a pumping phase and a position corresponding to a idling phase, in the idling phase, delivery apertures of the valve support being covered by the suction plate, while suction apertures of the valve support are partially exposed, wherein:

a) the suction plate is constructed as a disk which is held between the valve support and a compressor housing, being rotatable by operating devices relative to the valve support and consists of an active section acting in the pumping phase with respect to the suction apertures and of an inactive section connected with the active section, b) delivery apertures in the inactive section are, in the pumping phase, aligned with the delivery apertures of the valve support, and c) recesses are provided on both sides of the active section in a material of the inactive section after the rotation of the suction plate into the position corresponding to the idling phase, the recesses in an overlapping manner exposed a partial area of the suction apertures of the valve support, while the delivery apertures provided in the inactive section, after the rotation of the suction plate, are laterally offset with respect to the delivery apertures of the valve support such that the delivery apertures of the valve support are covered in the idling phase.

2. Piston-type compressor according to claim 1, wherein the operating devices used for rotating the suction plate consist of a fork situated on the suction plate's outer circumference in which a pin engages which can be operated by an operating piston or similar drive and is guided in a longitudinally displaceable manner in an oblong hole.

3. Piston-type compressor according to claim 1, wherein the active section has a tongue-shaped plate body and is stamped out of a material of the disk such that the free end of the tongue body is movable while the opposite end as the clamped-in end of the active section is connected with the inactive section.

4. Piston-type compressor according to claim 3, wherein the active section extends almost along the whole diameter of the disk and is limited on both sides by approximately semicircular inactive sections.

5. Piston-type compressor according to claim 4, wherein at least one delivery aperture respectively is situated in both inactive sections on both sides of the active section and, the delivery aperture is aligned in the pumping phase with a delivery aperture of the valve support.

6. Piston-type compressor according to claim 1, wherein the active section extends almost along the whole diameter of the disk and is limited on both sides by approximately semicircular inactive sections.

7. Piston-type compressor according to claim 6, wherein at least one delivery aperture respectively is situated in both inactive sections on both sides of the active section and, the delivery aperture is aligned in the pumping phase with a delivery aperture of the valve support.

* * * * *